US006419014B1

(12) United States Patent
Meek et al.

(10) Patent No.: US 6,419,014 B1
(45) Date of Patent: Jul. 16, 2002

(54) APPARATUS AND METHOD FOR ORIENTING A DOWNHOLE TOOL

(75) Inventors: Dale E. Meek; Lawrence J. Leising, both of Sugar Land; John D. Rowatt, Richmond, all of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/621,277

(22) Filed: Jul. 20, 2000

(51) Int. Cl.[7] ..... E21B 47/024
(52) U.S. Cl. ..... 166/255.2; 175/45
(58) Field of Search ..... 175/45, 40, 61; 166/255.2, 250.01, 66, 66.4

(56) References Cited

U.S. PATENT DOCUMENTS

| | | | | | |
|---|---|---|---|---|---|
| 4,462,469 | A | * | 7/1984 | Brown | 175/40 |
| 4,678,045 | A | * | 7/1987 | Lyons | 175/61 |
| 5,215,151 | A | | 6/1993 | Smith et al. | |
| 5,311,952 | A | | 5/1994 | Eddison et al. | |
| 5,314,030 | A | * | 5/1994 | Peterson et al. | 175/26 |
| 5,316,094 | A | | 5/1994 | Pringle | |
| 5,339,913 | A | | 8/1994 | Rives | |
| 5,373,898 | A | | 12/1994 | Pringle | |
| 5,394,951 | A | | 3/1995 | Pringle et al. | |
| 5,485,889 | A | | 1/1996 | Gray | |
| 5,669,457 | A | | 9/1997 | Sebastian et al. | |
| 5,735,357 | A | | 4/1998 | Palm | |
| 5,894,896 | A | | 4/1999 | Smith et al. | |
| 6,116,354 | A | * | 9/2000 | Buytaert | 175/55 |
| 6,158,529 | A | * | 12/2000 | Dorel | 175/61 |
| 6,315,062 | B1 | * | 11/2001 | Alft et al. | 175/45 |

FOREIGN PATENT DOCUMENTS

WO 96/19635 6/1996

OTHER PUBLICATIONS

L.J. Leising et al., Extending the Reach of Coiled Tubing Drilling (Thrusters, Equalizers, and Tractors), SPE 37656, *SPE/IADC Drilling Conference*, pp. 1–14 (Mar. 4–6, 1997).
US 2001/0052427, Eppink et al., "Three Dimensional Steerable System," pub. date Dec. 2001, pub. classification 175–40.*

* cited by examiner

*Primary Examiner*—David Bagnell
*Assistant Examiner*—Zakiya Walker
(74) *Attorney, Agent, or Firm*—Jennie (JL) Salazar; Brigitte L. Jeffery; John J. Ryberg

(57) ABSTRACT

An orienter, particularly on coiled tubing or small diameter drill pipe, includes a motor, turbine, or other device for selectively converting the rotational kinetic energy produced from fluid flow through the device to mechanical power, and applying the mechanical power to a downhole tool through a gear train for orienting the downhole tool. The orienter is utilized during directional drilling and other operations such as well intervention, fishing, and multilateral re-entry operations. The downhole tool preferably includes a steerable mud motor. In one embodiment, the direction of the borehole is controlled by azimuthal rotation of the orienter of the present invention in response to downlink commands from the surface by changing fluid flow rate through the orienter in a predefined series of steps.

41 Claims, 13 Drawing Sheets

APPARATUS AND METHOD FOR ORIENTING A DOWNHOLE TOOL

BACKGROUND OF THE INVENTION

1. Field of the Invention

The present invention relates generally to the field of drilling and servicing subsurface wells, and more specifically to an apparatus and method for converting the kinetic energy of the flow of fluid past a device such as a turbine into rotational kinetic energy and for applying the rotational kinetic energy of the device to rotate a steerable motor or other downhole tool relative to a point of reference. In more detail, the present invention relates to an orienter for use in directional drilling, fishing operations, well intervention, or for re-entry of multilateral wells, particularly on coiled tubing (CT) or small diameter drill pipe. In one embodiment, the invention includes means for using mud flow through the tool for generating electricity for powering a motor for rotating the downhole tool, and a method of orienting a downhole tool with electricity generated downhole.

2. The Related Art

A directional or deviated borehole is typically drilled using a positive displacement mud motor, a bent housing, and a bit that are suspended on drill pipe that extends downwardly into the borehole from the surface. The drill pipe is rotated at the surface to orient the bent housing to control the tool face angle and thus the azimuth at which the borehole is drilled. The motor is generally powered by pumping a weighted drilling fluid (mud) down the drill string and through the motor.

Coiled tubing (CT) can be run into a borehole that is under pressure through blowout preventers using a tubing injector and, with a drilling motor mounted on or near the end of the tubing, is particularly useful in some circumstances for drilling deviated boreholes and for accommodating multiphase drilling fluids. However, CT cannot be rotated at the surface to achieve directional steering of a drilling motor and bent housing. For that reason, the bottom hole assembly (BHA) generally includes an orienter that is operated by pulsing the drilling fluid by cycling the pumps on and off, each change causing the orienter to rotate by an incremental amount to orient the bent housing relative to the direction of the CT to achieve a desired tool face angle. Other systems control the orienter by running hydraulic and/or electric umbilicals or cables from the surface for both power and two-way data telemetry between the surface and the downhole tools. Such systems have the advantage of higher power and insensitivity to multiphase drilling fluids. In some systems known in the art, the electric cable provides electric power to an electric motor for controlling the tool face angle and to continuously rotate the bent housing when desired for straight ahead drilling. Examples of such tools include those described in U.S. Pat. No. 5,894,896 (hydraulic), U.S. Pat. No. 5,669,457 (hydraulic), U.S. Pat. No. 5,215,151 (mud pulse), U.S. Pat. No. 5,311,952 (mud pulse), U.S. Pat. No. 5,735,357 (mud pulse), and International Application No. PCT/EP95/05163 (WO 96/19635) (electric cable).

However, such systems are characterized by a number of disadvantages and limitations that compromise their utility. For instance, the fluid inertia time delay of mud pulse systems make orienting the bent housing a time consuming process. Further, the flow rate must be reduced substantially and the bit must be "off bottom" during orienting, necessarily interrupting drilling operations. Further, the use of multiphase or gaseous drilling fluid hampers and significantly slows the operation of these pressure operated orienters. Also, most such systems are capable of rotation in only one direction by a set increment such that it is necessary to rotate 345° counterclockwise if it is desired to rotate, for instance, 15° clockwise. Straight ahead drilling requires a series of 180° arcs for certain mechanical tools, or removing the bend from the BHA (requiring a trip to the surface).

Adding umbilicals to the system increases available power and torque, but necessarily complicates deployment, requires increased surface pump pressure to achieve the necessary flow rates with which to drill reducing coil life, and impacts the process of cementing and completing the well after drilling.

There is, therefore, a need for an apparatus and method for orienting a downhole tool that overcomes these limitations. It is therefore a general object of the present invention to provide an orienter with increased power and torque delivery downhole that produces mechanical or electrical power with a downhole turbine or other device that is rotated by the flow of drilling mud or other fluid.

A further object of the present invention is to provide an orienter that converts the hydraulic energy of fluid pumped in a borehole to power for directly rotating a downhole tool.

Another object of the invention is to convert the whole or a part of the fluid energy into electrical energy for powering an electric motor, electric clutch, and/or an electronic sensor and control package.

Another object of the present invention is to provide a downhole orienter that is operated while drilling, thereby reducing down time.

Another object of the present invention is to provide a downhole orienter that does not have "umbilicals" to the surface but is insensitive to the presence of multiphase drilling fluids.

It is also an object of the present invention to provide an orienter that is utilized for quickly and reliably orienting a downhole tool to a desired azimuth in a single step.

It is also an object of the present invention to provide an orienter capable of continuous rotation.

It is also an object of the present invention to provide an orienter that comprises a closed loop system with a steering tool for continuously orienting to an absolute heading while drilling and maintaining a specified inclination and/or build-up rate.

It is also an object of the present invention to provide an orienter for use in downhole operations other than drilling, such as well intervention, orienting a whipstock or multilateral re-entry tool, for setting a packer, kickpad or other diverter, or for fishing operations.

Other objects, and the advantages, of the method and apparatus of the present invention will be made clear to those skilled in the art by the following description of the presently preferred embodiments thereof.

SUMMARY OF THE INVENTION

These objects are achieved by providing an improved orienter for a downhole tool that generates rotational kinetic energy from the flow of fluid through the orienter for rotating the tool relative to a point of reference. In a preferred embodiment, the orienter selectively rotates the downhole tool in response to an input signal.

In another aspect, the present invention is directed to an apparatus for orienting a tool in a borehole comprising a device for converting fluid flow into rotational kinetic energy, means for applying the rotational kinetic energy of the device to change the orientation of a tool in the borehole, and means for communicating a desired change in the orientation of the tool to the kinetic energy applying means. In a preferred embodiment, the direction communicating means is responsive to one or more of a signal from the surface, a signal from a direction and inclination package, or a signal from an MWD/LWD tool. In one preferred embodiment, the rotational kinetic energy applying means includes a gear train that converts a higher velocity, lower torque input into a lower velocity, higher torque output. In a second preferred embodiment, the rotational kinetic energy applying means includes an alternator for generating electrical power from the rotational kinetic energy of the device and an electric motor powered by the electricity generated by the alternator.

In another aspect, the present invention is directed to an orienter for a downhole tool comprising a device for converting fluid flow through the device into rotational kinetic energy, an alternator operably connected to the device for converting the rotational kinetic energy produced by the device into electricity, and either a motor powered by the electricity produced by the alternator or an electrically operated clutch operably connected to the alternator. In one embodiment, control circuitry that is also powered by the electricity produced by the alternator is also provided for selectively operating the motor for orienting a downhole tool. The device may include means reactive to input signals from the surface for selectively orienting the downhole tool. The signal sensing means may be reactive to, for instance, reciprocating movement of the tubular string or changes in the pressure or fluid flow past the device, or in the case of the above-described control circuitry, the control circuitry may sense other input signals such as a telemetered signals from the surface, or signals from a direction and inclination package, or an MWD/LWD tool.

Also provided is a method for orienting a tool in a borehole relative to a point of reference. In a preferred embodiment, the method of the present invention comprises the steps of pumping a fluid through a tubular string in a borehole, generating rotational power from the hydraulic energy of the pumped fluid, and utilizing the rotational power generated from the hydraulic energy of the pumped fluid to selectively rotate a tool relative to a point of reference. The rotational power generated from the hydraulic energy of the pumped fluid is mechanical power or electric power, the former being utilized directly to rotate the tool and the latter being utilized either to power an electric motor that rotates the tool or to actuate a clutch that operably connects the alternator to the tool.

BRIEF DESCRIPTION OF THE DRAWINGS

FIGS. 5A–54L are longitudinal sectional views of a preferred embodiment of a portion of a BHA including an orienter constructed in accordance with the teachings of the present invention.

FIG. 6 is a logic diagram showing one embodiment of the control logic of the CPU of the orienter of FIG. 5.

DETAILED DESCRIPTION OF THE PREFERRED EMBODIMENTS

Figure 1:
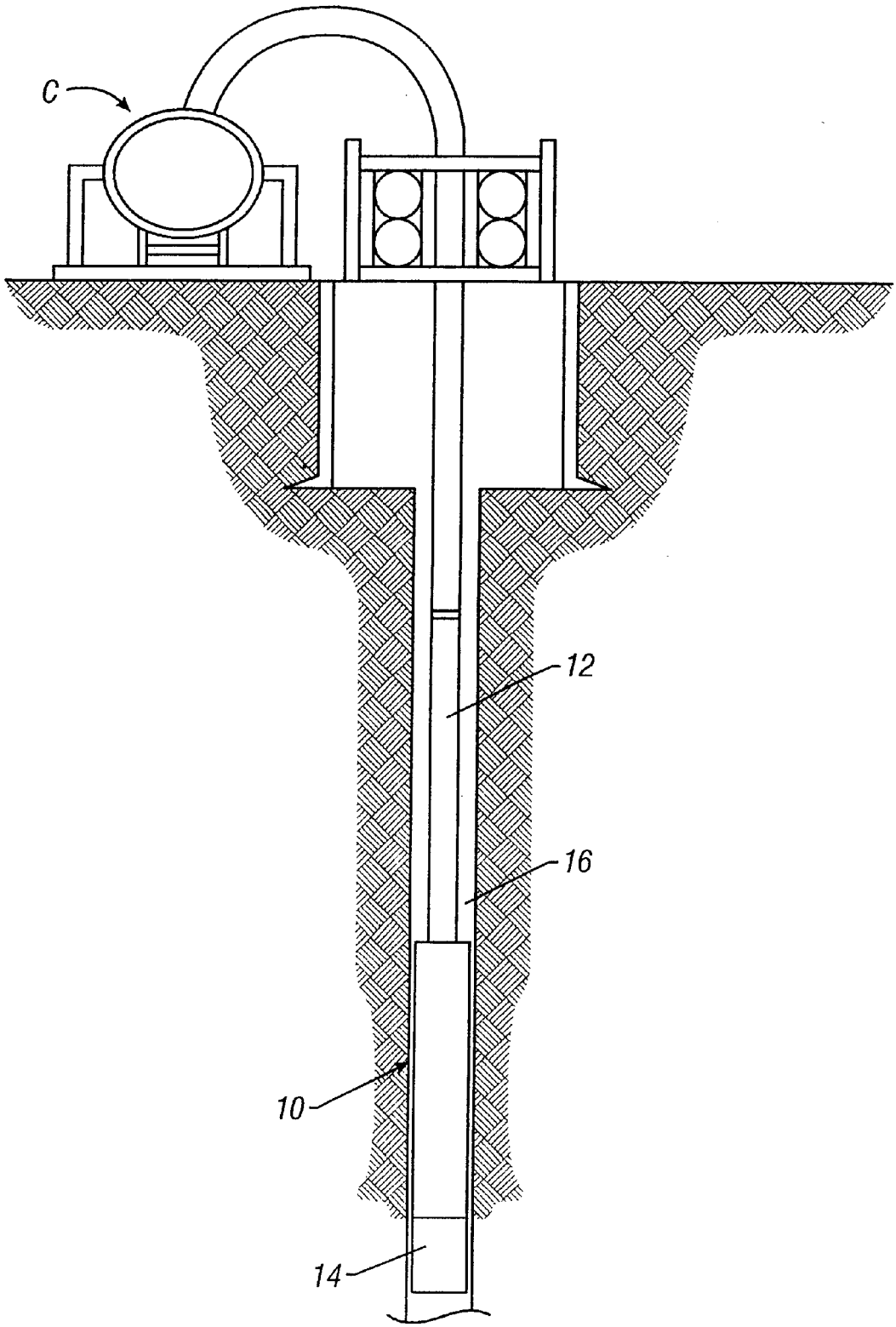
FIG. 1 is a schematic view of a coiled tubing (CT) string having been run into a borehole, the CT string including a preferred embodiment of an orienter constructed in accordance with the teachings of the present invention.

Referring to FIG. 1, a preferred embodiment of the orienter of the present invention is indicated generally at reference numeral 10. In the embodiment shown, orienter 10 is mounted on the end of a coiled tubing (CT) string 12 above a tool 14 in a borehole 16, the CT string extending to a coiled tubing unit C at the surface. Although not limited to use in directional drilling, those skilled in the art will recognize from this disclosure that the orienter 10 is frequently utilized as one component of a bottom hole assembly, or BHA, in which the downhole tool includes a steerable mud motor, which contains a bent housing or sub, or variable gauge stabilizer (VGS) and a drill bit (all designated generally at reference numeral 14). In the particular case of a VGS, orienter is utilized to perform mechanical work in the form of varying the gauge of the VGS to drop or build angle.

As will be described below, however, the orienter 10 of the present invention is adapted for placement at other locations in the CT string 12 and for orienting and/or setting tools other than a steerable mud motor, such as a multilateral re-entry tool, well intervention tool, whipstock, muleshoe, kickpad or other diverter, a packer, or a fishing tool.

Figure 2:
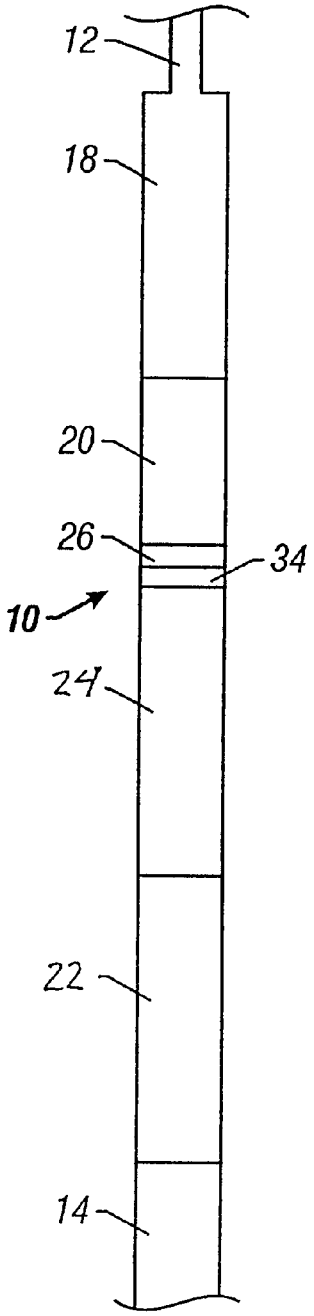
FIG. 2 is a diagrammatic view of a bottom hole assembly (BHA) on the end of the CT string of FIG. 1 including a preferred embodiment of the orienter of the present invention.
Figure 4:
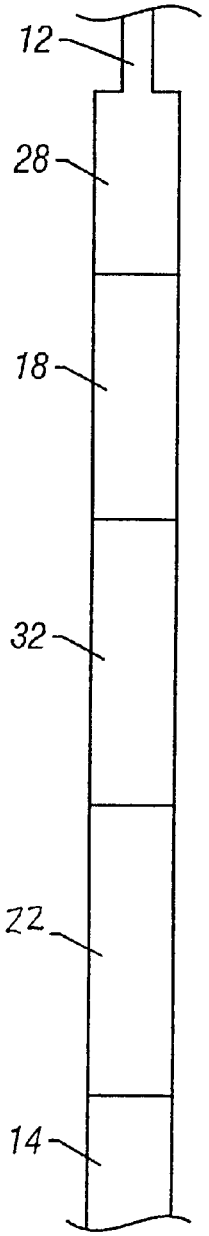
FIG. 4 is a diagrammatic view of a bottom hole assembly (BHA) on the end of a CT string such as the CT string of FIG. 1 including a second preferred embodiment of the orienter of the present invention.
Figure 5A:
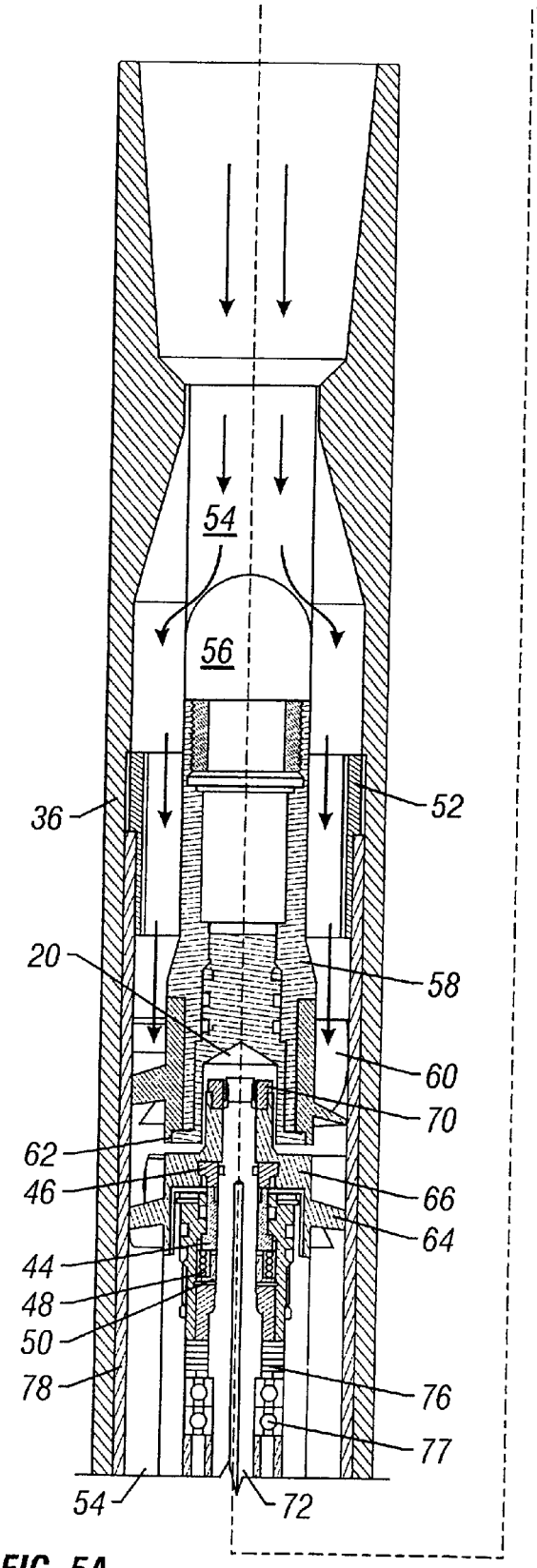
Figure 5B:
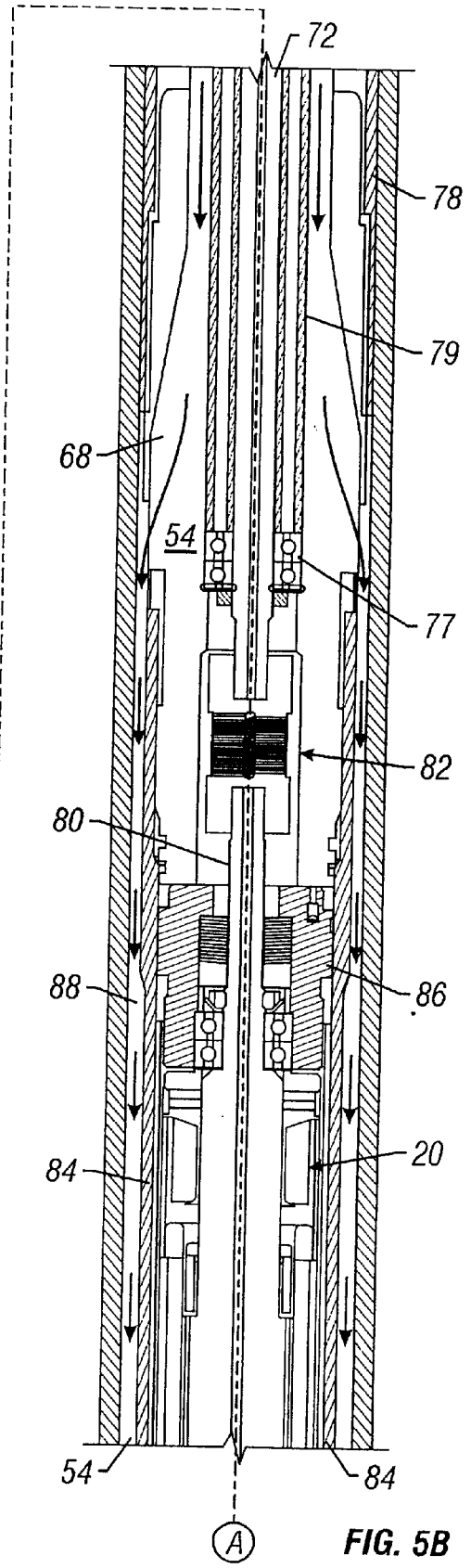
Figure 5C:
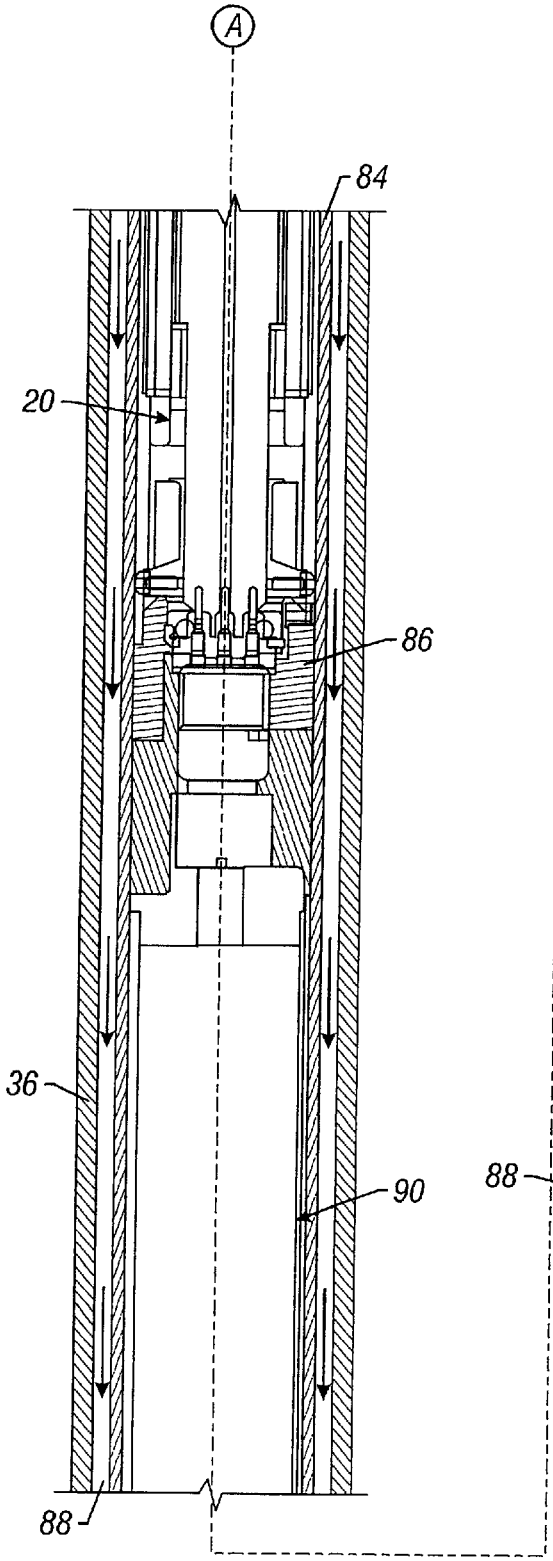
Figure 5D:
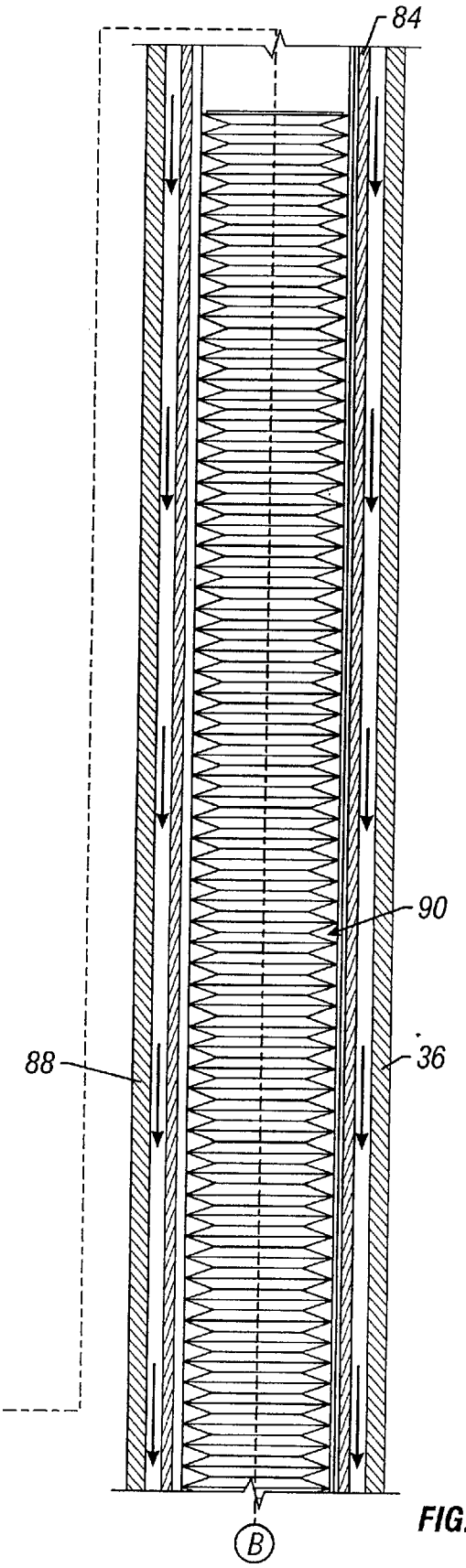
Figures 5E, 5F:
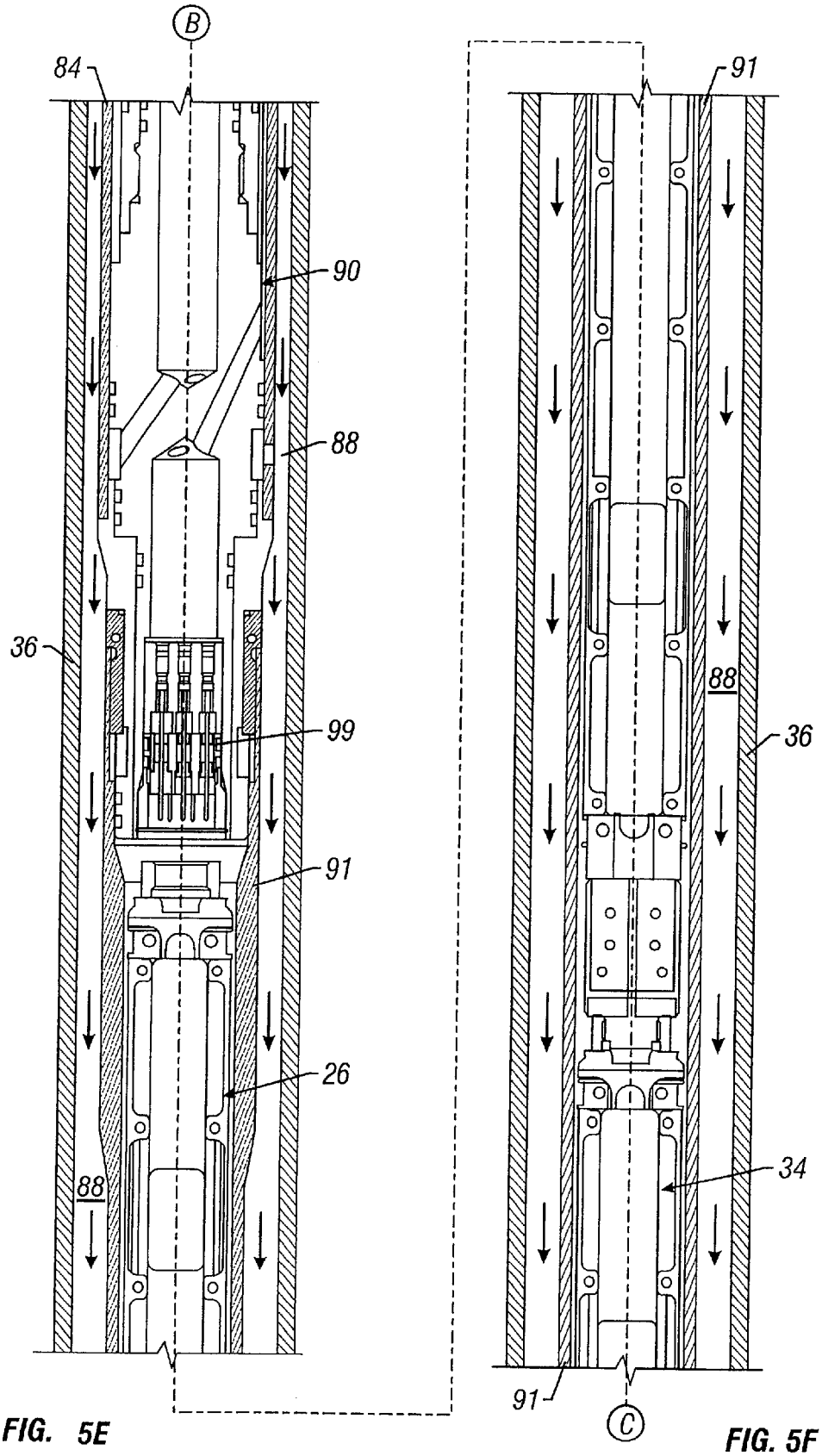
Figure 5G:
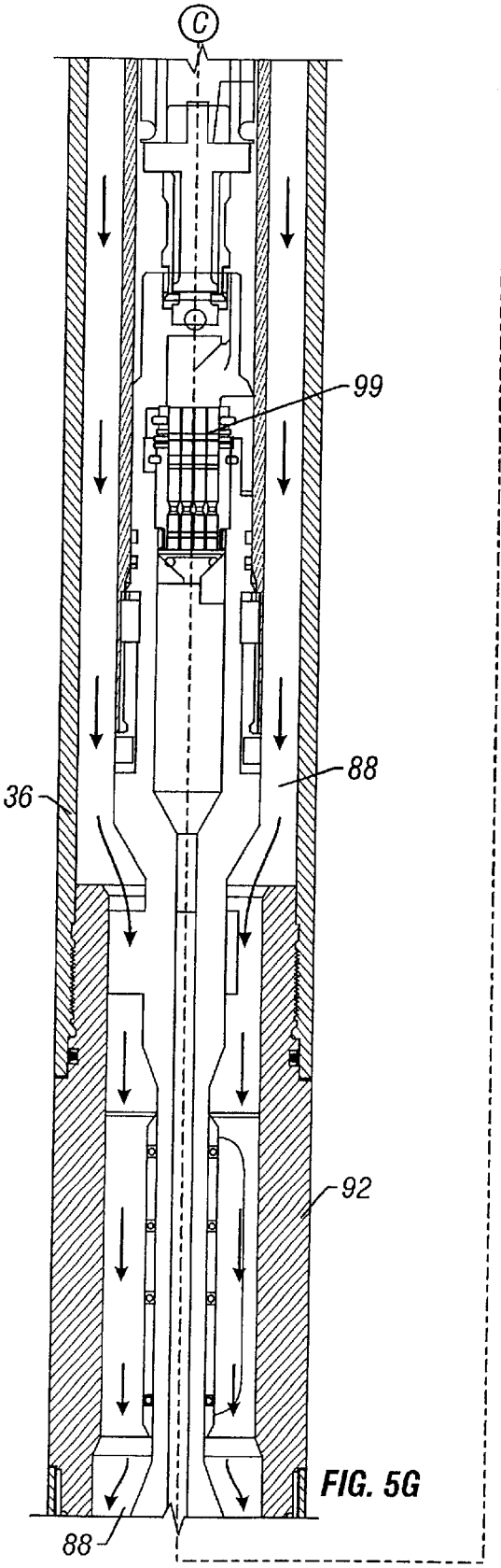
Figure 5H:
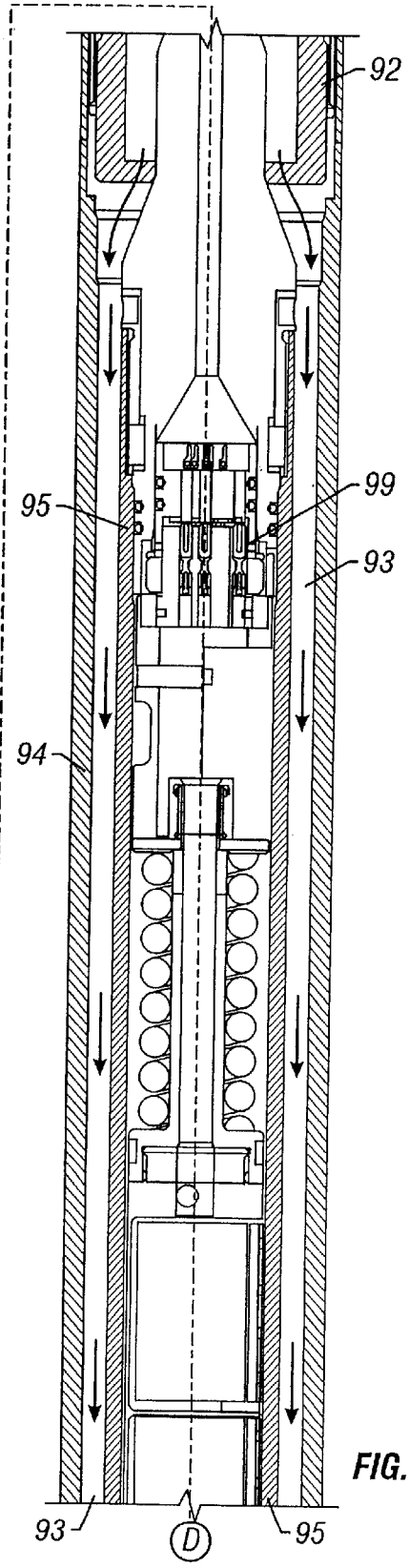
Figure 5I:
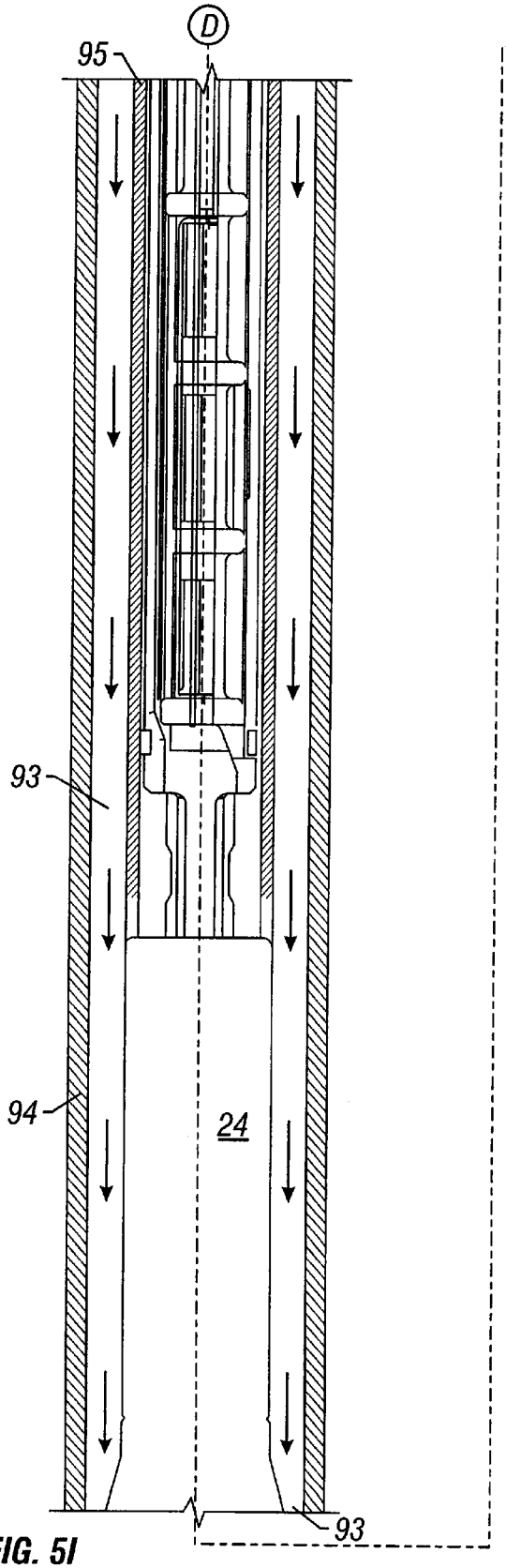
Figure 5J:
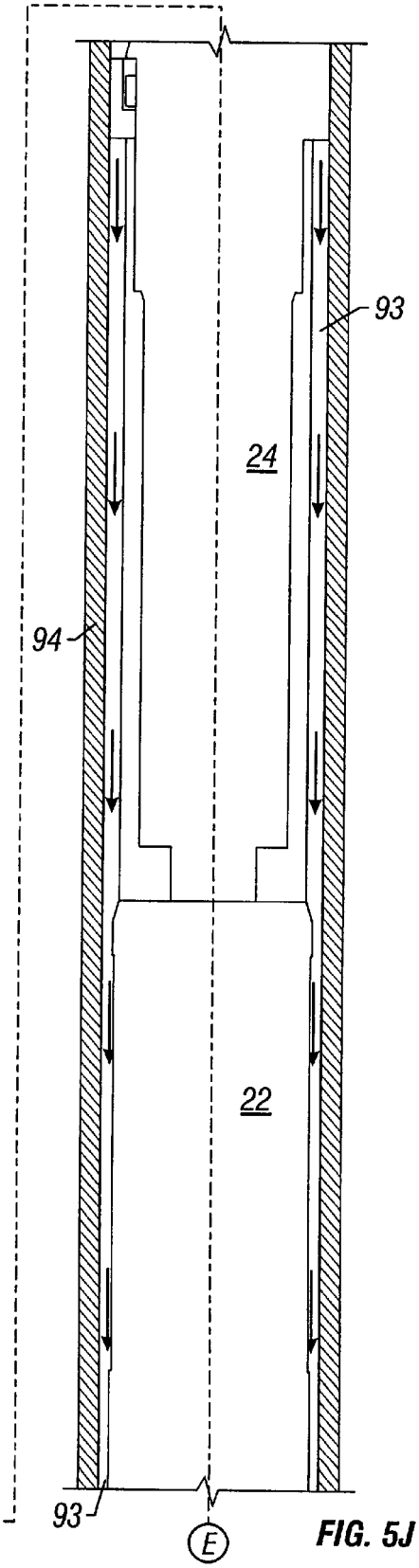
Figure 5K:
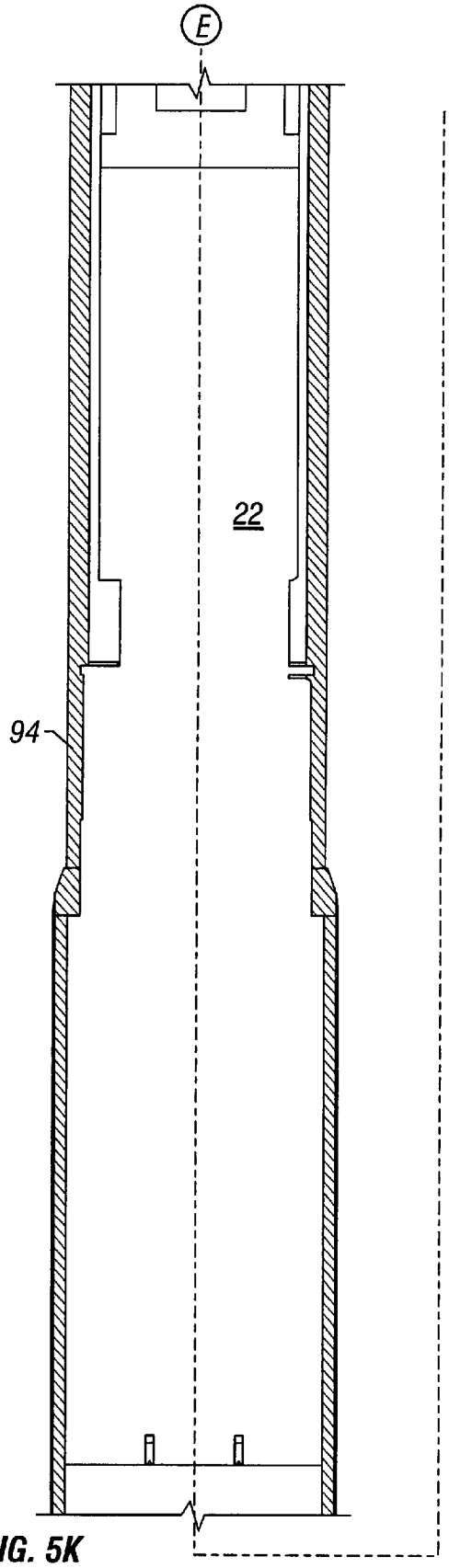
Figure 5L:
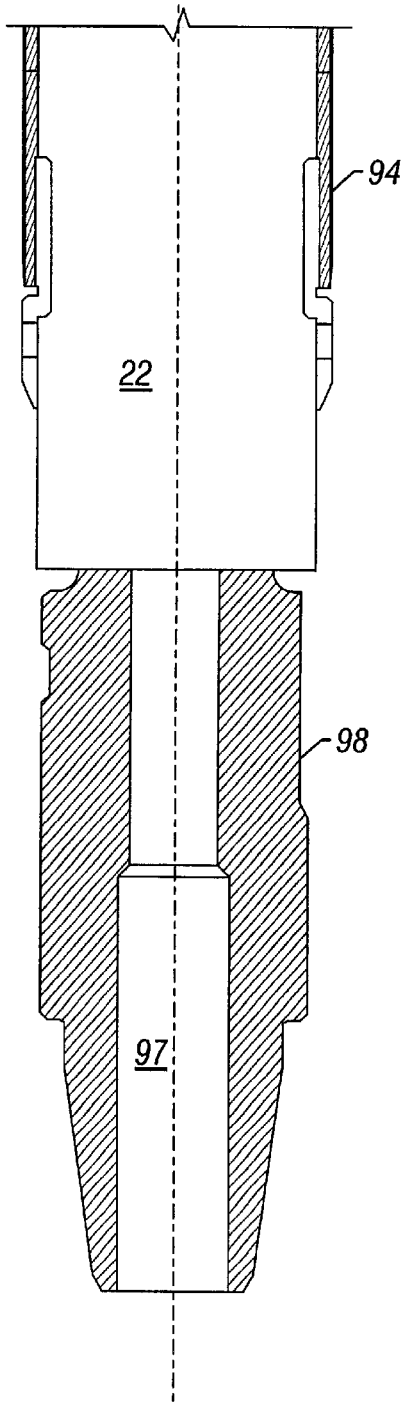

Further, as illustrated in FIGS. 2 and 4, which show the component parts of the orienter 10 diagrammatically, the orienter of the present invention is constructed in multiple embodiments. In a first embodiment shown in FIG. 2, orienter 10 includes a device 18 that is operably connected to an alternator 20. In a preferred embodiment, device 18 is a turbine that converts the fluid flow through CT 12 into rotational kinetic energy, the output shaft of which is coupled to the drive shaft of an alternator 20. Device 18 can be a positive displacement motor, but a turbine is presently preferred and the device will generally be referred to as a turbine hereinafter. Alternator 20 therefore converts the rotational kinetic energy produced by turbine 18 into electricity. Electricity produced by the alternator 20 powers a motor 24, the output shaft (not shown in FIG. 2) of which is operably connected to a gear train 22 for orienting the tool 14 under selective control of the electronic circuitry 26 relative to a reference point. Alternatively, the alternator is operably connected to the downhole tool 14 through gear train 22 by an electrically actuated clutch (not shown). Those skilled in the art who have the benefit of this disclosure will recognize that a solenoid actuated pawl or engageable splines or teeth will also function to operably connect the rotational kinetic energy of turbine 18 and alternator 20 to gear train 22. Those skilled in the art who have the benefit of this disclosure will also recognize that in an embodiment in which the clutch or other connection is electrically activated, said clutch can be actuated from the surface by, for instance, changes in fluid flow, by telemetered signals from the surface, input from a D & I package, or input from an MWD/LWD tool. When the tool 14 is a steerable mud motor having a drilling bit mounted thereto, the tool 14 may be oriented relative to any of a number of reference points, including the components of the BHA (including the orienter itself), the CT 12, the borehole itself, the earth, an operator-selected set of coordinates, or any other reference point that is known in the art.

Orienter 10 may be operated in at least two modes. In a first mode, orienter 10 is optionally equipped for operation in "stand-alone" mode, meaning that it does not communicate with a separate MWD tool. Alternatively, orienter 10 is operated in a second mode in which it is integrated with an MWD tool for communication therewith. A primary difference between first and second modes is that an MWD tool provides uplink telemetry capabilities to the surface that would otherwise be absent.

Figure 3A:
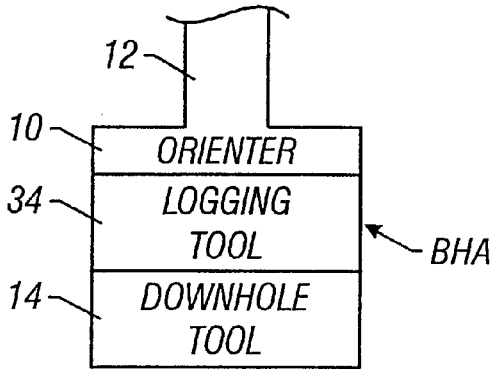
FIGS. 3A and 3B are diagrammatic views showing two ways in which the orienter of the present invention is made up in the BHA of FIG. 2.
Figure 3B:
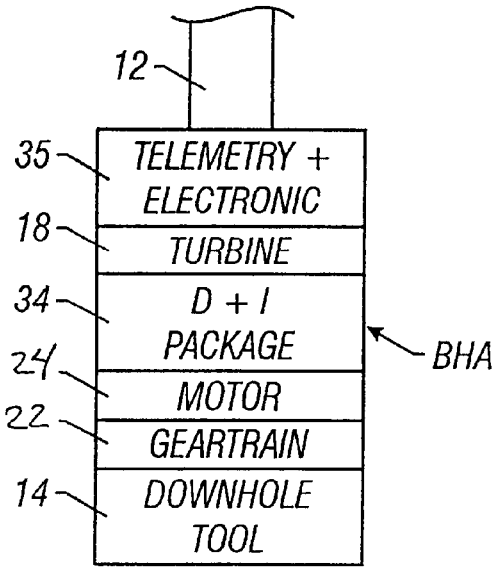

The differences in the stand-alone and integrated modes are partly illustrated by FIGS. 3A and 3B, which show the manner in which the orienter of the present invention is made up in a BHA depending upon whether the orienter is to be operated in the standalone (FIG. 3A) or integrated (FIG. 3B) mode. In the stand-alone mode (FIG. 3A), the orienter 10 is preferably made up in the BHA above the MWD tool 37 and tool 14. As shown in FIG. 3B, when integrated with the MWD tool in the BHA, the components of both the orienter 10 and MWD tool 37 are preferably split apart to facilitate integration of the orienter 10 with MWD tool 37. In this integrated mode, the electronics (designated at reference numeral 35) for the telemetry uplink comprising MWD tool 37 are preferably made up in the BHA above the turbine 18 and the MWD tool 37 itself is made up in the BHA between the turbine 18 and motor 24 and gear train 22.

There are at least two configurations for the stand-alone mode, the first including a direction and inclination (D & I) instrumentation package 34 (shown in FIG. 2) permitting tool 14 to be oriented according to an absolute heading that may be input by downlink telemetry signals from the surface to package 34. The D & I package 34 may be powered by the electricity generated through the rotational kinetic energy of turbine 18. Thus, this first stand-alone mode allows for versatile downlink signals, absolute heading, and other information to be sent from the surface for orienting. The second stand-alone configuration of orienter 10 (not shown) does not include a D & I package, and therefore is not capable of providing orientation according to an absolute heading input. In this second stand-alone mode, however, the orienter of the present invention is capable of providing a relative change in orientation using sensors such as a resolver on motor 24 or a Hall effect sensor on turbine 18 or geartrain 22, both of which are well known in the art, to measure the position of the output shaft and to validate absolute tool face orientation on every revolution.

In the alternative to the stand-alone mode in which orienter 10 is integrated with an MWD tool, orienter 10 communicates with the MWD tool (shown diagrammatically at 37 in FIG. 3B) made up in the BHA. In a preferred embodiment of this integrated mode, the MWD tool 37 is powered by orienter 10 with electricity generated from the rotational kinetic energy of turbine 18, thereby obviating the need for battery power on the MWD tool. However, those skilled in the art will recognize that the MWD tool need not be powered by the electricity generated by alternator 20 in order to be included within the scope of the present invention. In a particularly preferred embodiment, the electrical circuitry 26 of orienter 10 is coupled to the MWD tool 37 by communication and power lines, allowing orienting to an absolute heading, in other words, control of the tool face relative to a point of reference, such as the earth or as provided by a D & I package, if present. The MWD tool provides uplink telemetry through which the status of the tool may be reported, among other things.

Regardless of whether orienter 10 includes a D & I package 34 (stand-alone) or is integrated with an MWD/LWD tool, orienter 10 is used to achieve an absolute heading by: (a) rotating and then holding tool 14 at a selected orientation relative to a reference point; (b) continuously rotating tool 14 to drill straight ahead, or (c) regulating the percentage of time tool 14 is oriented and the time spent continuously rotating in order to achieve a desired build-up rate.

In the embodiment shown in FIG. 2, the circuitry 26 includes sensors that react to input commands to selectively activate motor 24 without reducing fluid flow to the point that the mud motor stalls while drilling. The input commands may take several forms such as are known in the art, including mud pulses/changes in the rate of fluid flow as measured by changes in the rotational speed of the turbine 18, changes in fluid pressure, reciprocating movement of the CT string 12, electromagnetic or wireline telemetered input signals from the surface, or other forms known in the art and/or hereafter invented. The circuitry 26 can also include logical operators for interpreting a re-programming or override command for motor 24 sent via one of the above-mentioned forms of telemetry.

Referring to the second embodiment of the, orienter of the present invention shown in FIG. 4, the kinetic energy of the fluid passing down CT 12 through the orienter 10 is converted to rotational kinetic energy by a device 18 that (as noted above) is preferably a turbine. The orienter 10 is preferably controlled by the flow rate of the fluid in CT 12, but those skilled in the art who have the benefit of this disclosure will recognize that pressure changes or other input commands from the surface, for instance, reciprocation of CT string 12, may also be utilized for that purpose by selecting a piston 28 or other structure that is responsive to reciprocation rather than flowrate. Increases in flow rate force a piston 28 downwardly against the bias of a spring (not shown in FIG. 4) to position a pin in a J-slot sleeve on the piston (also not shown in FIG. 4 but described below in connection with FIGS. 7 and 8) in a position in which the output shaft of turbine 18 selectively engages (or disengages) a clutch 32 to operably stop the rotation of turbine 18 or optionally connect turbine 18 to a gear train 22, the output shaft of gear train 22 rotating a downhole tool 14 mounted thereto. Gear train 22 converts the high angular velocity, low torque rotational kinetic energy of the turbine 18 into low angular velocity, high torque rotational movement of an output shaft, the tool 14 being mounted thereto.

Those skilled in the art will recognize that this modulating mechanism, although described herein as a clutch, is advantageously adapted for connecting turbine 18 to gear train 22 with structure other than a mechanically activated clutch. For instance, although an engageable friction face is described below and shown in FIGS. 7–8, the connection is also accomplished by a clutch that is, for instance, electrically activated, the electrical power being provided by a battery. Those skilled in the art who have the benefit of this disclosure will recognize that the clutch 32 can also be replaced with a solenoid actuated pawl or engageable splines to stop motion of the turbine or a clutch for disconnecting the turbine 18 from gear train 22. Thus, it will be recognized that the various connections between turbine 18 and gear train 22 can be mechanically activated (e.g., by a piston that reacts to changes in the flow rate or differential pressure of the fluid in CT 12) or electrically activated. Those skilled in the art who have the benefit of this disclosure will also recognize that in a mechanical embodiment of the orienter of the present invention in which clutch 32 is electrically activated, the piston 28 can be omitted.

Referring now to FIGS. 5A–5L, an orienter constructed in accordance with the present invention is shown in detailed, longitudinal section. A housing 36 having a bore 54 receives mud or other fluid from the coiled tubing (not shown), the bullnose 56 distributing fluid flow around a stator mount 58 that is retained between housing 36 and turbine housing 78 by jam nut 52 and stator retainer 62. The fluid flows past stator mount 58 through stator 60 and then past the blades 64 of rotor 66, causing the rotor 66 to rotate. A plurality of radially extending fins 68 are provided downstream of rotor 66 for anchoring the turbine housing 78 and, for those embodiments noted above and described in more detail below in which the orienter of the present invention is integrated with the MWD tool, routing wires for communication and power delivery past the rotor 66. Rotor 66 is retained on rotor shaft 72 by a retainer nut 70, rotor shaft 72 having a rotating face seal 44 rotating therewith. The rotor 66 rides on a seal carrier 42 that carries a stationary face seal 44 against which the rotor face seal 46 bears. The stationary face seal 44 is biased against the rotor face seal by a wave spring 48 that is trapped in spring support 50, and the entire seal assembly is biased against rotor 66 by Belleville springs 76.

Rotor shaft 72 is journaled in the bearings 77 of a bearing spacer 79 and coupled through flexible coupling 82 to the alternator shaft 80 of alternator 20. Alternator 20 is confined within alternator housing 84 in housing 36 between upper and lower end caps 86. Fluid is routed into the annulus 88 between alternator housing 84 and housing 36 that extends past pressure compensator 90, electrical circuitry 26, and D & I package 34, through the centralizer assembly 92, and then through the annulus 93 between the lower housing 94 and motor housing 95. Fluid flows in annulus 93 past motor 24 and gear train 22, and out through the bore 97 in the output shaft 98 to the mud motor (not shown). The electricity output from alternator 20 is routed via appropriate wiring (not shown in the drawings for purposes of clarity) through feed-throughs 99 and/or in grooves (not shown) formed in the various housings as needed to provide electricity to the motor 24.

From the foregoing description, it can be seen that the preferred embodiment of the orienter 10 of the present invention that is shown in FIGS. 5A–5L (and in FIG. 2 as described above) is comprised of means for generating electricity for powering an electric motor in the orienter for selectively rotating a downhole tool relative to orienter 10 through a geartrain. The geartrain converts the high rpm, relatively low torque of the electric motor into low rpm, relatively high torque rotational kinetic energy as needed to do effective mechanical work against a high torque load as required to rotate and orient a bent sub, overcome the reactive torque produced by a drilling mud motor in the act of drilling subsurface lithologies, retrieve downhole tools from a wellbore, re-enter lateral boreholes, set whipstocks, kickpads, and packers, and conduct fishing operations.

Regardless of whether the orienter 10 is integrated with the MWD tool or operated in the above-described stand-alone mode, angular velocity of turbine 18 (and thus flow rate through the tool) is measured in the manner known in the art, for instance, by measuring the frequency of the alternator ac power output with a comparator and converting the sine wave output into a square wave that a gate array converts into pulse count. By changing fluid flow rate in a series of stepped changes, commands are built and interpreted by the CPU located in the electrical circuitry 26 that is powered by alternator 20 using a lookup table of commands stored in the CPU memory. The commands specify one or more of the following operations:

- rotate a specified number of degrees in a manner similar to known mechanical orienters but with the ability to rotate in either direction by any specified number of degrees rather than in a fixed increment;
- rotate to an absolute heading, thereby avoiding the need for a long series of pressure pulses as needed to rotate known orienters to achieve a large change in orientation;
- continuous rotation for drilling straight ahead and/or maintaining a heading and inclination; and
- closed loop control of toolface or inclination for either maintaining a heading or inclination without additional downlink commands from the surface or, for instance, holding the last toolface heading requested.

Figure 6:
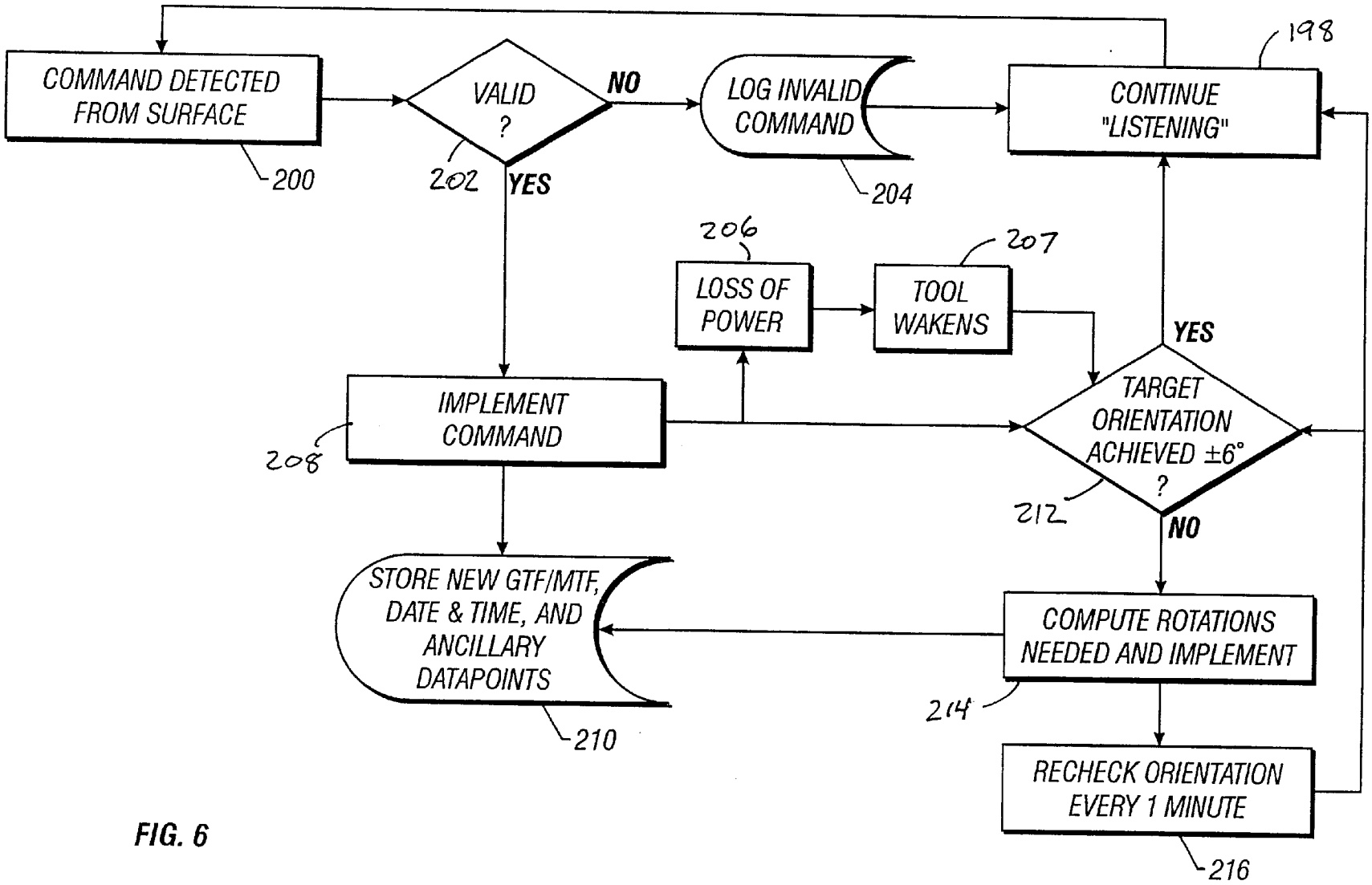

One embodiment of the manner in which the orienter of the present invention is controlled and operated is shown in schematic form in the logic diagram set out in FIG. 6. The logic shown in FIG. 6 is programmed into the CPU of electrical circuitry 26, which polls, or "listens" for commands (step 198) from the surface under control of an internal oscillator. When a command is detected as at step 200, validity is tested in accordance with operator set parameters (step 202) of flow rate values within a set of error bands for specified time durations also within a set of error bands. Unique commands are built of multiple flow rate changes and times that define unique sequences. If flow rates or times fall outside of the predefined error bands stored in the tool software and the sequence detected is determined invalid (step 204), the CPU continues "listening" as at step 198; if valid, the command is implemented (step 208) and new GTF/MTF, date and time, and ancillary datapoints are stored to memory (step 210). Target orientation is tested as at step 212, and if orientation is within tolerance, the CPU waits for subsequent commands 198. If target orientation does not test within specified tolerance at step 212 as measured by the MWD sensors, the number of degrees of rotation needed to implement and/or correct to the target orientation is computed and implemented (step 214) and rechecked at selected time intervals (step 216). The control logic includes a loss of power step 206 for detecting, for instance, a no flow or low flow situation in the borehole that might prevent implementation of the command. After detecting a loss of power, the tool awakens (step 207) and once again tests to determine if target orientation has been achieved (step 212). A virtually identical control logic is used, for instance, in an orienter constructed in accordance with the present invention that includes an electrically actuated clutch or solenoid operated pawl for selectively applying the torque rotational kinetic energy produced by turbine 18 to an orient a downhole tool.

A first preferred mechanical embodiment of the orienter of the present invention constructed as diagrammed in FIG. 4 above is shown in detail in FIG. 7. In the embodiment shown in FIG. 7, the orienter comprises an outer housing 112 that is made up in the BHA and that includes a movable piston 100 having a passage 101 therethrough, the passage 101 being provided with a nozzle 114 having a reduced diameter orifice 102 therein. Piston 100 is movable within housing 112 between four positions in response to cycles of differential fluid pressure at reduced diameter orifice 102 for orienting the downhole tool (not shown in FIG. 7). Those skilled in the art who have the benefit of this disclosure will recognize that the orifice may also be located at the drilling motor/bit if the piston is operated by differential pressure changes in the CT/annulus. However, it is preferred that piston 100 cycle between positions in response to differential fluid pressure at reduced diameter orifice 102 rather than in response to pressure changes at the drilling motoribit since the former location is flow rate sensitive while the latter location is differential pressure sensitive and is therefore more dependent on well conditions.

Figure 7A:
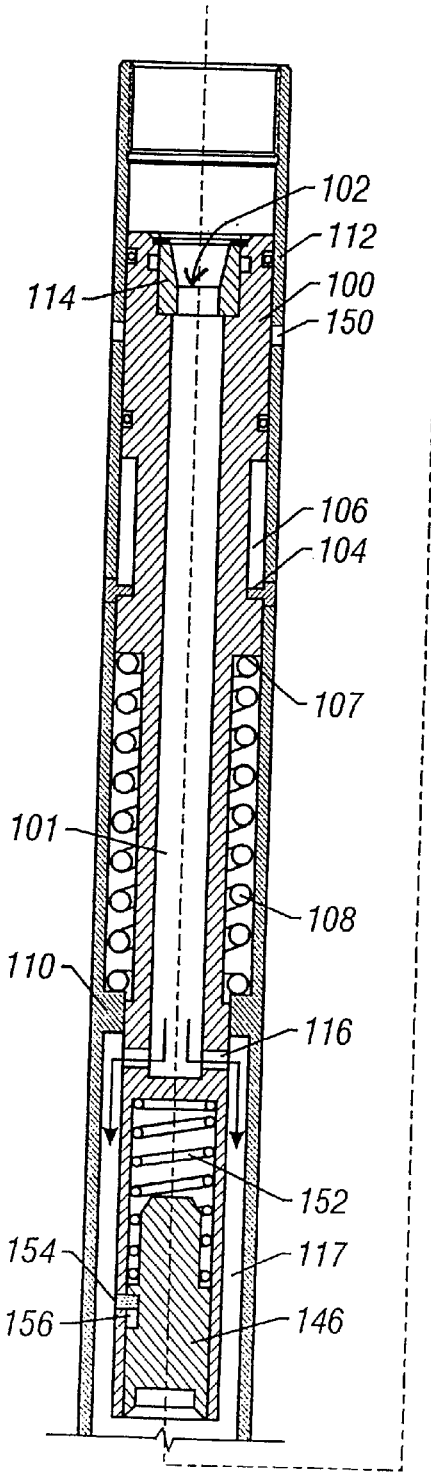
FIGS. 7A and 7B are longitudinal sectional views showing the details of one embodiment of the orienter shown diagrammatically in FIG. 2 that is constructed in accordance with the teachings of the present invention and FIG. 7C is an elevational view of a portion of the piston comprising the orienter of FIG. 7 removed from the orienter to show the J-slots formed in the outside surface thereof.

As the flow is cycled, piston 100 moves in sequence between positions as follows, the pin 104 being positioned in a corresponding position in the J-slot 106 formed on the outer diameter of piston 100:

Pumps off, piston 100 positioned in a first, up position shown in FIG. 7A by the bias applied by the spring 108 trapped between the shoulder 110 of housing 112 and the shoulder 107 formed on piston 100. When piston 100 is in this first, up position, the pin 104 integral with the housing 112 is positioned in the lowest position in slot 106 (the latter being best shown in FIG. 7C).

Pumps on, piston 100 forced downwardly in housing 112 by fluid flow/pressure at the reduced diameter orifice 102 against the bias of spring 108 to the position at which fluid entering nozzle 114 exits piston 100 through ports 116 and travels down through the bore 117 in housing 112 past the stator 118 and turbine 120. When the piston 100 is forced downwardly by fluid pressure to this second position, the pin 104 is positioned in the second lowest position/slot in J-slot 106, which is in the shortest of the upwardly-extending J-slots 106. In this second position, the high rpm, low torque rotational kinetic energy of turbine 120 resulting from the flow of fluid past turbine 120 is converted into low rpm, high torque rotational kinetic energy of output shaft 122 by coupling the turbine output shaft 124 to gear train 126 through a spring-loaded, friction clutch 128, the gear train output shaft 130 being coupled to output shaft 124, and hence the tool (not shown) mounted to the orienter of the present invention. When the piston 100 is positioned in this second position with pin 104 in the second lowest position in J-slot 106, the output shaft 124 rotates continuously until the pressure is again cycled. As the output shaft 124 rotates, the flow of fluid is blocked momentarily once each rotation as the inlet port 132 in gear train output shaft 130 by the blocker 134 integral with the inside surface of the bore 117 in housing 112. This momentary stoppage in fluid flow provides a brief increase in the pressure of the fluid flowing through bore 117, thereby signalling the operator and acting as a rotational reference point as to the operating status of the orienter of the present invention. A friction clutch 128 is provided to protect the gear train 126 and is of a conventional nature, being comprised of a clutch shoe 136, spring 138, anti-rotation pin 140, and clutch pad 142, the later being coupled to the input shaft 144 of gear train 126.

Pumps off, piston 100 up to the above-described first position with pin 104 again being positioned in the lowest position in J-slot 106.

Pumps on, piston 100 down to a third position in which the brake clutch 146 engages the friction face 148 formed on the end of turbine 120 and rotation of the turbine 120 is resisted. In this third position of piston 100, pin 104 resides in a third position in the J-slot 106. Brake clutch 146 is biased downwardly into engagement of the friction face 148 by spring 152 and rotation of the brake clutch 146 is resisted by the anti-rotation pin 154 in the slot 156 formed in the outside diameter of brake clutch 146.

Pumps off, piston 100 up to the above-described first position with pin 104 again being positioned in the lowest position in J-slot 106.

Pumps on, piston 100 down to a fourth position in which the brake clutch 146 engages the friction face 148 on the end of turbine 120, rotation of turbine 120 is resisted, and flow ports 150 in housing 112 are opened for fluid circulation without rotation of turbine 120. In this fourth position of piston 100, the pin 104 resides in a corresponding fourth position in J-slot 106 in the longest of the three upwardly-extending slots. As noted above, spring 152 biases brake clutch 146 downwardly into engagement with friction face 148 and rotation of brake clutch 146 is resisted by anti-rotation pin 154 in the slot 156.

Figure 7B:
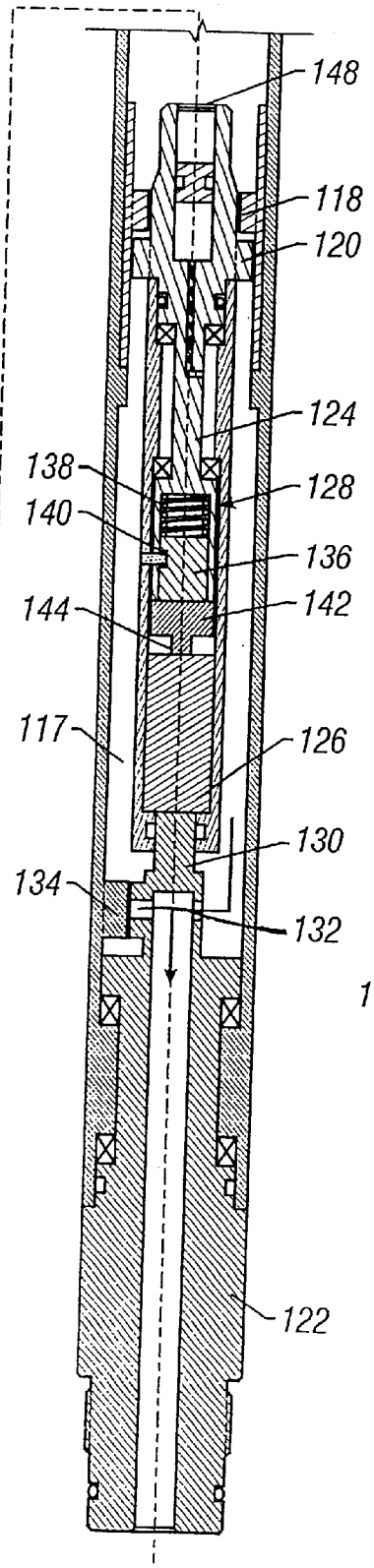
Figure 7C:
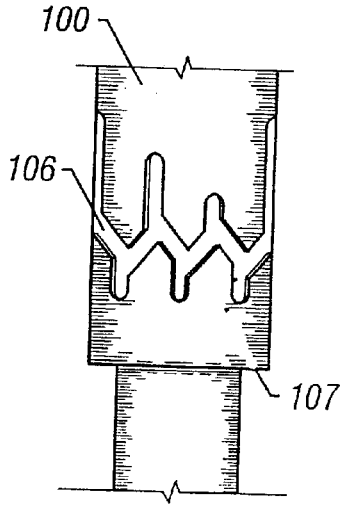
Figure 8A:
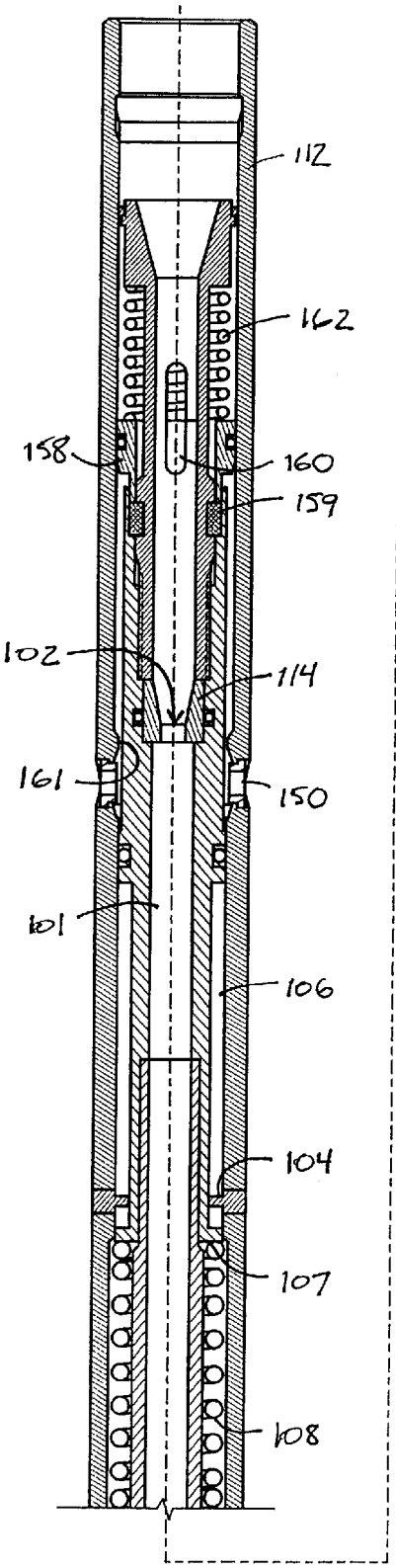
FIGS. 8A–8C are longitudinal sectional views showing the details of the second embodiment of the orienter shown diagrammatically in FIG. 4 that is constructed in accordance with the teachings of the present invention.
Figure 8B:
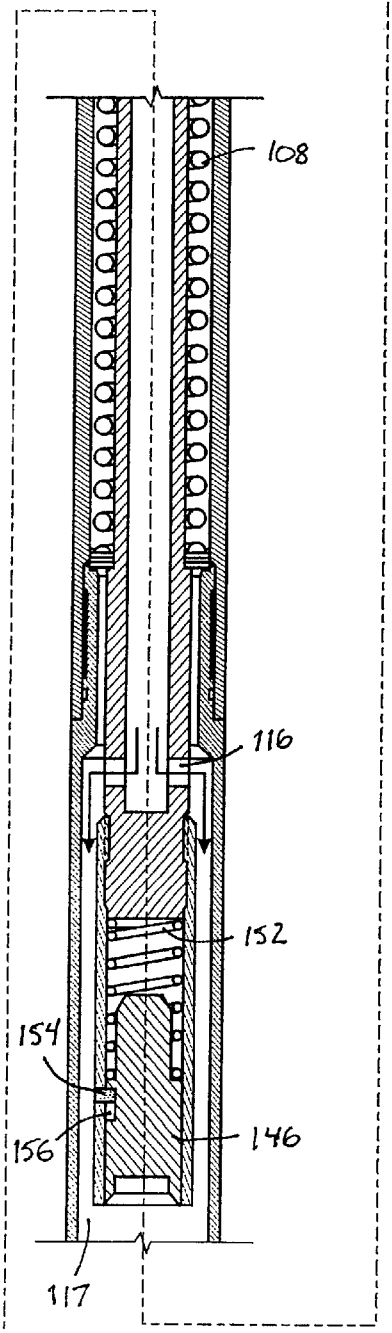
Figure 8C:
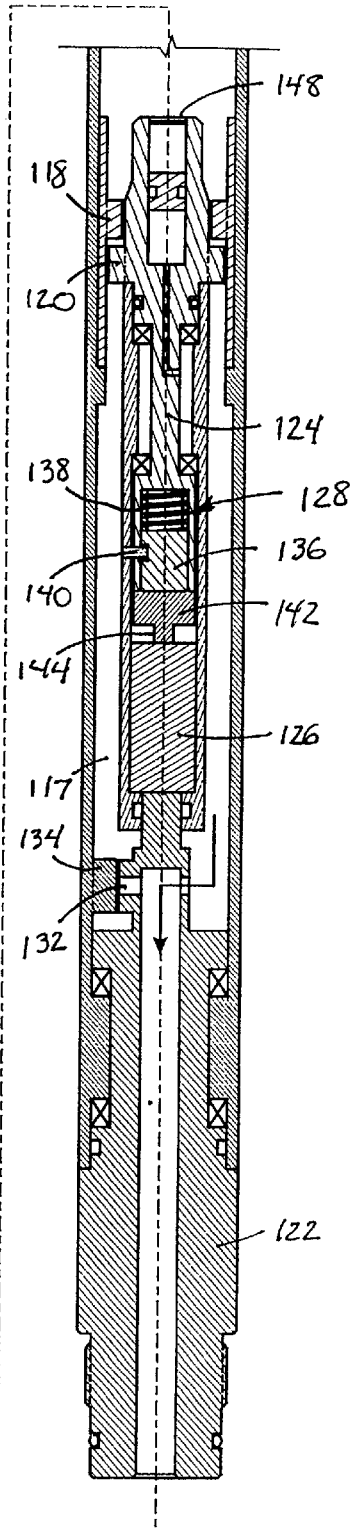

In this mechanical embodiment, the orienter of the present invention is preferably placed above the measurement while drilling (MWD) tools in the BHA so that the MWD tool can provide information on the orientation and position of the tool. An alternative embodiment of the orienter of FIG. 7 is shown in FIGS. 8A–8C. In the alternative embodiment shown in FIGS. 8A–8C, control of rotation of a tool mounted to the orienter of the present invention is accomplished by exertion of mud flow/pressure against the spring-loaded piston 100 in the same manner as in the embodiment shown in FIGS. 7A–7C, but fluid circulation is accomplished by increasing the pressure at reduced diameter orifice 102 until the gate 158 carrying face seal 159 is forced downwardly and contacts shoulder 161 which prevents downward movement of gate 158, thus lifting gate 158 off of face seal 159 so that fluid can escape from piston 100 through slots 160 and out the exit ports 150 in housing 112, bypassing turbine 118. Gate 158 is normally biased upwardly by spring 162. Because the face seal 159 can withstand higher pressure than the seal effected by the O-rings carried on the piston 100 of the embodiment shown in FIGS. 7A–7C, the embodiment shown in FIGS. 8A–8C is particularly adapted for use in high differential pressure conditions. Those skilled in the art will also recognize that the circulation valve of the mechanical embodiments of the orienter of the present invention shown in FIGS. 7 and 8 can be omitted from the orienter without compromising its utility for orienting operations.

Figure 9B:
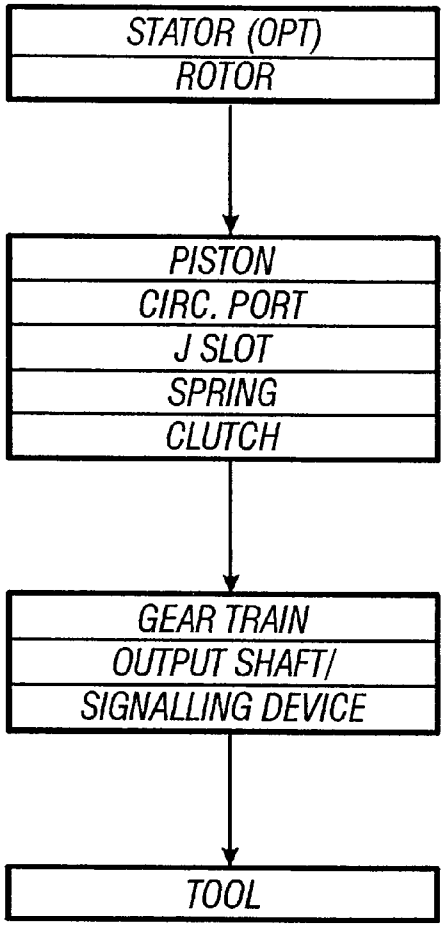
FIGS. 9A–9D are schematic diagrams illustrating the manner in which the component parts of the second embodiment of the orienter of the present invention as shown diagrammatically in FIG. 4 are made up in a BHA.
Figure 9A:
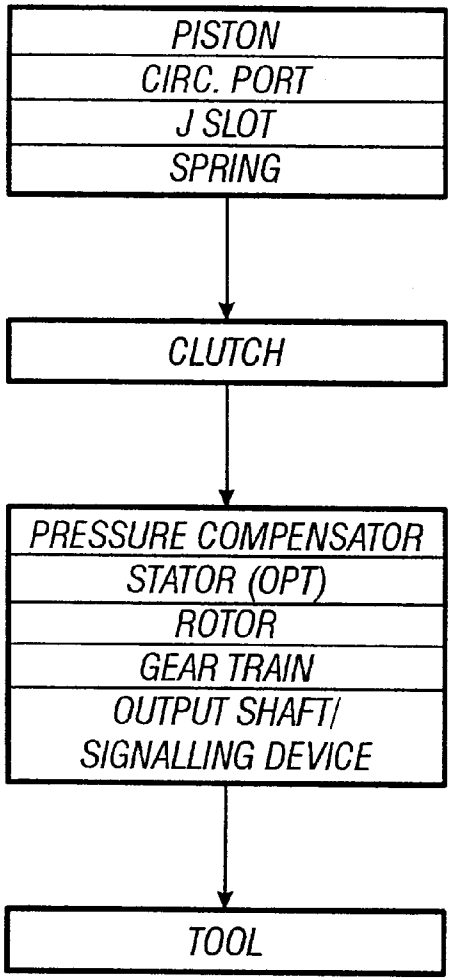
Figure 9D:
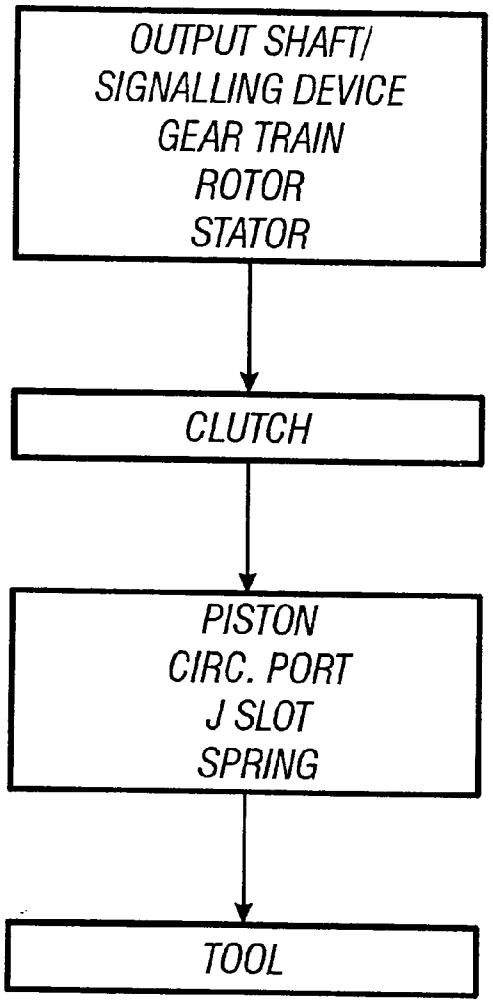
Figure 9C:
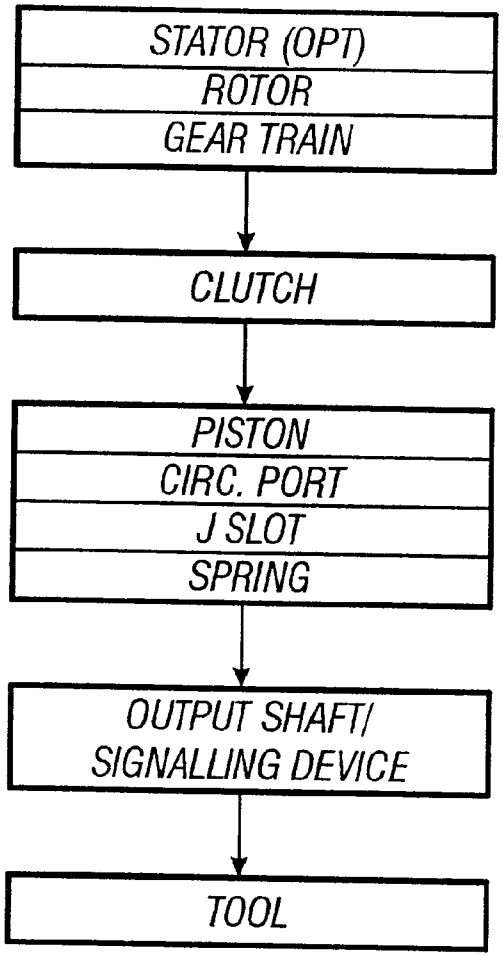

As set out above, the orienter of the present invention is constructed in at least three preferred embodiments, one that uses an alternator to generate electricity that powers a motor and geartrain, or that is operably connected through an electromechanical clutch and geartrain to the downhole tool (FIGS. 2, 3A–3B, and 5A–5L) and one that generates mechanical power that is applied to the downhole tool through a clutch (FIGS. 4, 7A–7C, and 8A–8C) to change the orientation of a tool in the borehole. Those skilled in the art will recognize from this description that embodiments utilizing a clutch can utilize an electric clutch or a mechanical clutch, and that there are multiple variations of each embodiment. To illustrate, FIGS. 9A–9D show different arrangements of the component parts of the mechanical embodiments of an orienter for converting high rpm, low torque rotational kinetic energy at the turbine to low rpm, high torque rotational energy at an output shaft for orienting a downhole tool using a clutch. The arrangement shown in FIG. 9A corresponds to the embodiments shown in FIGS. 7A–7C and 8A–8C and described above. FIGS. 9B and 9C are provided to show that the turbine rotor can be located above the piston (FIG. 9B) and that the turbine rotor can be located above the clutch that can also be located above the piston (FIG. 9C). FIG. 9D shows the arrangement of the component parts of an embodiment utilizing the above-described electrically actuated clutch.

Those skilled in the art will recognize that the description set out herein is a description of the presently preferred embodiment of the invention, that the preferred embodiment described herein is not the only embodiment of the invention, and that other embodiments can be constructed in accordance with the teachings set out herein that function to accomplish the purposes described herein that are intended to fall within the scope of the present invention. All such changes, and others which will be made clear to those skilled in the art by this description of the preferred embodiments of the invention, are intended to fall within the scope of the following, non-limiting claims.

What is claimed is:

1. An orienter for a downhole tool, comprising:

a device in the orienter for generating rotational kinetic energy from the flow of fluid past the orienter; and means for applying the rotational kinetic energy to position the downhole tool relative to a point of reference whereby the downhole tool is placed in a desired orientation.

2. The orienter of claim 1 wherein said point of reference is one or more of an operator-specified set of coordinates, the earth in which the downhole tool resides, or said orienter.

3. The orienter of claim 1 additionally comprising a sensor for sensing an input signal for controlling rotation of the downhole tool in response to the input signal.

4. The orienter of claim 3 wherein said sensor comprises means for sensing the flow rate of a fluid.

5. The orienter of claim 1 wherein said device for generating rotational kinetic energy is a turbine.

6. The orienter of claim 1 additionally comprising a set of gears for converting high rpm, low torque rotation of said device to low rpm and high torque rotation of the downhole tool.

7. The orienter of claim 1 additionally comprising means for detecting rotation of the downhole tool.

8. The orienter of claim 7 additionally comprising means for outputting a signal from said rotation detecting means.

9. Apparatus for orienting a tool in a borehole comprising:

a device connectable to the tool, the device capable of converting fluid flow past said device into rotational kinetic energy;

means for applying the rotational kinetic energy of said device to position the tool whereby the tool is placed in a desired orientation; and means for communicating the desired orientation of the tool to said energy applying means.

10. The apparatus of claim 9 wherein said energy applying means comprises a gear train for converting the high angular velocity and low torque rotational kinetic energy from said device into low angular velocity and high torque rotational energy.

11. The apparatus of claim 9 wherein said communicating means is responsive to a signal from the surface.

12. The apparatus of claim 9 wherein said kinetic energy applying means comprises a clutch.

13. The apparatus of claim 9 further comprising means for verifying a change in orientation.

14. The apparatus of claim 13 wherein said verifying means comprises sensors for detecting a change in direction relative to said orienter.

15. The apparatus of claim 13 wherein said verifying means comprises sensors for detecting rotation of the tool.

16. The apparatus of claim 13 wherein said verifying means comprises a logging tool for sensitive change in direction relative to the earth.

17. The apparatus of claim 13 wherein said verifying means comprises means for effecting a mud pulse at intervals as said orienter is rotated.

18. The apparatus of claim 9 wherein said energy applying means generates mechanical power.

19. The apparatus of claim 9 wherein said energy applying means generates electrical power.

20. The apparatus of claim 9 wherein said communicating means is responsive to a signal from a downhole tool.

21. The apparatus of claim 9 wherein said kinetic energy applying means comprises an electric motor.

22. The apparatus of claim 9 further comprising means for verifying a change in orientation.

23. An orienter for a downhole tool comprising:

a device connectable to the downhole tool, the device capable of converting fluid flow past said device into rotational kinetic energy;

an alternator operably connected to said device, said alternator capable of converting the rotational kinetic energy produced by said device into electricity;

a motor powered by the electricity produced by said alternator; and control circuitry for selectively operating said motor whereby the downhole tool is positioned in a desired orientation.

24. The orienter of claim 23 additionally comprising output means for providing information as to the orientation of the downhole tool.

25. The apparatus of claim 24 wherein said output means comprises sensors for detecting a change in rotation of the downhole tool.

26. The orienter of claim 24 wherein said output means comprises a telemetry system.

27. The apparatus of claim 24 wherein said output means comprises a logging tool for sensing a change in orientation of the downhole tool relative to the earth.

28. The apparatus of claim 24 wherein said output means comprises means for effecting a mud pulse at intervals during orientation of the downhole tool.

29. The orienter of claim 23 additionally comprising a gear train for converting high rpm, low torque rotation of said motor to low rpm, high torque rotation of the downhole tool.

30. The orienter of claim 23 wherein said control circuitry for operating said motor comprises means for sensing the flow rate of the fluid.

31. The orienter of claim 23 wherein said device is carried on a tubular string and said control circuitry is responsive to movement of said tubular string.

32. A method of orienting a downhole tool relative to a point of reference comprising the steps of:

pumping a fluid through a tubular string in a borehole;

generating rotational power from the hydraulic energy of the pumped fluid; and utilizing the rotational power generated from the hydraulic energy to selectively position a downhole tool relative to the point of reference whereby the downhole tool is placed in a desired orientation.

33. The method of claim 32 wherein electric power is generated from the hydraulic energy of the pumped fluid and the electric power is converted into mechanical energy.

34. The method of claim 33 wherein the electric power is selectively utilized to orient the downhole tool in response to one or more of input commands received from the surface, an integral D & I package, or a D & I package included within an MWD tool positioned in the borehole.

35. The method of claim 32 wherein mechanical power is generated from the hydraulic energy of the pumped fluid to orient the tool.

36. The method of claim 35 wherein the mechanical power is selectively utilized to orient the downhole tool in response to an input command received from the surface.

37. The method of claim 32 wherein the circulating fluid is drilling mud and the downhole tool is a bent sub.

38. The method of claim 37 wherein the bent sub is selectively oriented to drill a directional borehole.

39. The method of claim 32 wherein the downhole tool is selected from the group consisting of a whipstock, muleshoe, kickpad, variable gauge stabilizer, steerable mud motor fishing tool, well intervention tool, or multilateral re-entry tool.

40. The method of claim 32 wherein hydraulic power is generated from the hydraulic energy of the pumped fluid to perform mechanical work.

41. The method of claim 40 wherein the mechanical work performed is varying the gauge of a variable gauge stabilizer.

* * * * *